US007269374B2

(12) United States Patent
Oka

(10) Patent No.: US 7,269,374 B2
(45) Date of Patent: Sep. 11, 2007

(54) IMAGE FORMING APPARATUS WITH INTERNAL TEMPERATURE CONTROL

(75) Inventor: Yushi Oka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 11/218,540

(22) Filed: Sep. 6, 2005

(65) Prior Publication Data

US 2006/0051124 A1 Mar. 9, 2006

(30) Foreign Application Priority Data

Sep. 8, 2004 (JP) ..... 2004-261455

(51) Int. Cl.
*G03G 21/20* (2006.01)

(52) U.S. Cl. ..... 399/94; 399/92

(58) Field of Classification Search ..... 399/44, 399/92, 94

See application file for complete search history.

(56) References Cited

U.S. PATENT DOCUMENTS 5,095,333 A * 3/1992 Shimada ..... 399/92
5,144,366 A * 9/1992 Sakamoto et al. ..... 399/92
6,885,836 B2 * 4/2005 Kimura et al. ..... 399/92
6,985,677 B2 * 1/2006 Yamagata et al. ..... 399/92

FOREIGN PATENT DOCUMENTS

JP 8-304938 11/1996
JP 2000-19931 1/2000

* cited by examiner

*Primary Examiner*—Sandra L. Brase
(74) *Attorney, Agent, or Firm*—Fitzpatrick, Cella, Harper & Scinto

(57) ABSTRACT

A full-color image forming apparatus has a cooling fan switchable between rotating speeds of "full speed" and "half speed." A transfer portion thermistor is installed near a photosensitive drum and an intermediate transfer member, and a printer control portion controls the rotating-speed switching of a cooling fan based on the temperature detected by the transfer portion thermistor. The printer control portion sets the rotating speed of the cooling fan at "half speed" when print job is started, sets a fan speed switching threshold value at 30° C. during the print job of only the single-side printing, sets the fan speed switching threshold value at 25° C. during a duplex print job, and switches the cooling fan to "full speed" when the detection temperature is higher than the set fan speed switching threshold value.

7 Claims, 7 Drawing Sheets

IMAGE FORMING APPARATUS WITH INTERNAL TEMPERATURE CONTROL

BACKGROUND OF THE INVENTION

1. Field of the Invention

The present invention relates to an image forming apparatus and a control method thereof and a program.

2. Related Background Art

Conventionally, in the image forming apparatus such as a copying machine, a printer, and a facsimile which are an electrophotographic type using toner during image forming, a fan is attached to the image forming apparatus in order to exhaust heat and air to the outside of the image forming apparatus. The number of rotations (or rotating speed) of the fan is controlled in order to suppress problems, such as noise and power consumption increase, caused by the attachment of the fan.

For example, Japanese Patent Application Laid-Open No. 2003-270890 discloses a method of changing the number of rotations of the fan depending on color image printing and monochrome image printing.

Japanese Patent Application Laid-Open No. 2004-117732 discloses a method, in which temperature detection means (thermistors) are provided in the image forming apparatus or peripheries of a fixing device and a transfer portion and the number of rotations of the fan is changed based on detection temperatures detected by the thermistors.

In the case of the use of the method disclosed in Japanese Patent Application Laid-Open No. 2004-117732, the fan is rotated at a half of normal speed when a print job is started, and the fan is switched to be rotated at the normal speed when the detection temperatures of the temperature detection means reach a predetermined threshold value, which suppresses the excessive temperature increase caused by the long time printing in the image forming apparatus. Accordingly, the method proposed in Japanese Patent Application Laid-Open No. 2004-117732 is effective from viewpoints of silence and electric power saving.

However, when the number of rotations of the fan is controlled based on the detection temperature detected by the temperature detection means as described above, because the temperature is detected near a position where the temperature detection means is installed, it is difficult to grasp the temperature of a component for which cooling is actually required in the image forming apparatus.

A main reason why the temperature of the component is increased in the image forming apparatus is that the heat generated from the fixing device which is of a heat source in the image forming apparatus diffuses with time. In the component arranged in a conveying path, the temperature is increased by direct heat transfer from the fixing device, and the temperature is also increased by indirect heat transfer from a recording sheet during conveyance through a conveying path. The recording sheet is heated by passage through the fixing device. Further, in the image forming apparatus with a recording sheet reverse mechanism in which the images can sequentially be formed in both the surface and the back side of the recording sheet, when compared to printing in which only single-side printing is continuously performed, the temperature tend to be increased in the case in which the printing including double-side printing is continuously performed.

In the image forming apparatus, a sheet discharging roller holder of a sheet discharging portion which discharges the recording sheet to the outside of the apparatus can be cited as the component in which the temperature is particularly easily increased during the printing. As shown in FIG. 7, a sheet discharging roller holder 703 nips the recording sheet with a sheet discharging roller 701 driven by a motor. The sheet discharging roller holder 703 supports a sheet discharging roller 702 which is rotated in conjunction with movement of the recording sheet during the sheet discharging. The sheet discharging roller holder 703 has a structure in which the sheet discharging roller holder 703 is vertically movable by a spring in order to smoothly performing the sheet discharging.

A material such as polycarbonate having relatively low heat-resistant temperatures ranging from 90° C. to 115° C. is used for the sheet discharging roller holder in order to reduce cost. On the other hand, because the temperature exceeds 200° C. during the printing in the fixing device which is of the heat source in the image forming apparatus, as shown in FIG. 8, the sheet discharging roller holder exceeds the heat-resistant temperature when the double-side continuous printing exceeds 120 minutes at a room temperature of 23° C. Therefore, when the print job including the double-side printing is performed for a long time, the sheet discharging roller holder is deformed and the recording sheet is not smoothly discharged, which results in the problems such as paper jam in the worst case.

In order to prevent the troubles, there is the method in which the rotating speed of the fan is increased compared with the normal speed in the case of the long time printing. However, at the room temperature of 23° C., the temperature increase in the single-side continuous printing is moderate when compared with the double-side continuous printing (see FIG. 8), so that the cooling fan is excessively driven when the single-side continuous printing is performed for a long time.

SUMMARY OF THE INVENTION

An object of the invention is to realize the silence and the electric power saving by suppressing cooling unit action at the minimum while the component deformation caused by the increased temperature is prevented in the image forming apparatus.

In order to achieve the object, an image forming apparatus according to the invention includes a printing unit which performs printing in a recording sheet by double-side printing or single-side printing; a temperature detection unit which detects a temperature of the inside of the image forming apparatus; a cooling unit which cools the inside of the image forming apparatus; and a control unit which compares the temperature detected by the temperature detection unit to a threshold value to control action of the cooling unit according to the comparison result, the control unit setting a first temperature as the threshold value when only the single-side printing is performed by the printing unit, the control unit setting a second temperature as the threshold value when at least one-time double-side printing is performed by the printing unit, the second temperature being lower than the first temperature.

Accordingly, while the component deformation caused by the increased temperature can be prevented in the image forming apparatus, the silence and the electric power saving can be realized by suppressing the number of rotations of the cooling unit at the minimum.

These and other objects and features of the invention will become more apparent upon a reading of the following detailed description and drawings.

DESCRIPTION OF THE PREFERRED EMBODIMENTS

Preferred embodiments of the invention will be described below with reference to the accompanying drawings.

Figure 1:
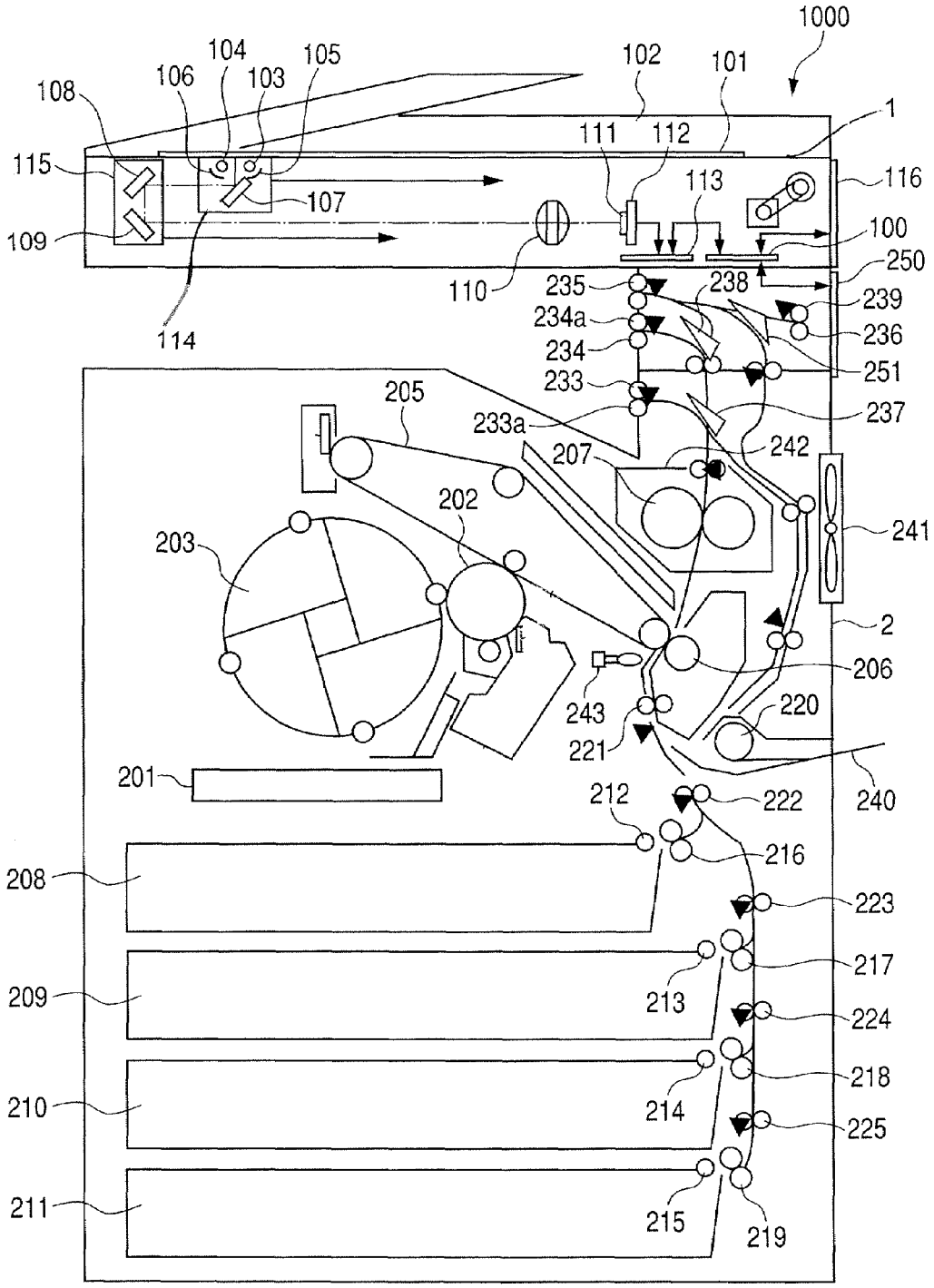
FIG. 1 is a block diagram schematically showing a full-color image forming apparatus which is of an image forming apparatus according to a first embodiment of the invention.

FIG. 1 is a block diagram schematically showing a full-color image forming apparatus which is of an image forming apparatus according to a first embodiment of the invention.

Referring to FIG. 1, a full-color image forming apparatus 1000 includes a color reader portion 1 and a color printer portion 2.

First a configuration of the color reader portion 1 will be described. The reference numeral 101 denotes an original plate (platen), and the reference numeral 102 denotes an automatic document feeder (ADF). It is also possible that a mirror-surface pressing plate or white pressing plate (not shown) is attached instead of the ADF 102. The reference numerals 103 and 104 denote a light source which lights an original. A halogen lamp, a fluorescent tube, a xenon lamp, and the like are used as the light sources 103 and 104. The reference numerals 105 and 106 denote a light reflector which condenses the light from the light sources 103 and 104 onto the original. The reference numerals 107 to 109 denote a mirror, and the reference numeral 110 denotes a lens. The lens 110 condenses the light reflected from the original or the light transmitted through the original onto a CCD (Charge Coupled Device) image sensor 111 (hereinafter simply referred to as the CCD). The reference numeral 112 is a board on which the CCD 111 is mounted, the reference numeral 100 denotes a control portion which controls the whole of the full-color image forming apparatus 1000, and the reference numeral 113 denotes a digital image processing portion. The reference numeral 114 denotes a carriage in which the light sources 103 and 104, the light reflectors 105 and 106, and the mirror 107 are accommodated. The reference numeral 115 denotes a carriage in which the mirrors 108 and 109 are accommodated. The carriage 114 is mechanically moved at speed V in a sub-scanning direction Y orthogonal to an electrical scanning direction (main scanning direction-X) of the CCD 111, and the carriage 115 is mechanically moved at speed V/2 in the sub-scanning direction Y, which allows the whole surface of the original to be scanned.

The CCD 111 is a sensor which converts the light, emitted from the light sources 103 and 104 and reflected from the original on the original plate 101, into an electric signal (analog image signal). When the CCD 111 is a color sensor, it is possible to use a one-line the CCD in which R, G, and B color filters are sequentially arranged in line in order of R, G, and B, or it is possible to a three-line CCD in which an R filter, a G filter, and a B filter are arranged in each CCD. Further, it is possible to use the CCD in which the RGB color filter is formed in the on-chip state, or it is possible to use the CCD in which the filter is separately formed.

The control portion 100 includes a CPU 301, an operation portion 303, and a memory 302. The CPU includes an interface (I/F) which exchanges information for controlling a digital image processing portion 113 (see FIG. 2) and a printer control portion 250 (see FIG. 1) of the color printer portion 2. The operation portion 303 includes a liquid crystal with a touch panel which displays a user input screen such as process execution contents or notification screen such as information on the process for an operator and a warning. The reference numeral 116 denotes an external interface (I/F) to other devices. Specifically, the external interface is connected to a facsimile apparatus (not shown) or a LAN interface device (not shown). The control of the exchange of image information and code information between the image forming apparatus and the facsimile apparatus (not shown) or the LAN interface device is performed by mutual communication between the CPU 301 and a control portion (not shown) of the connected external device.

Figure 2:
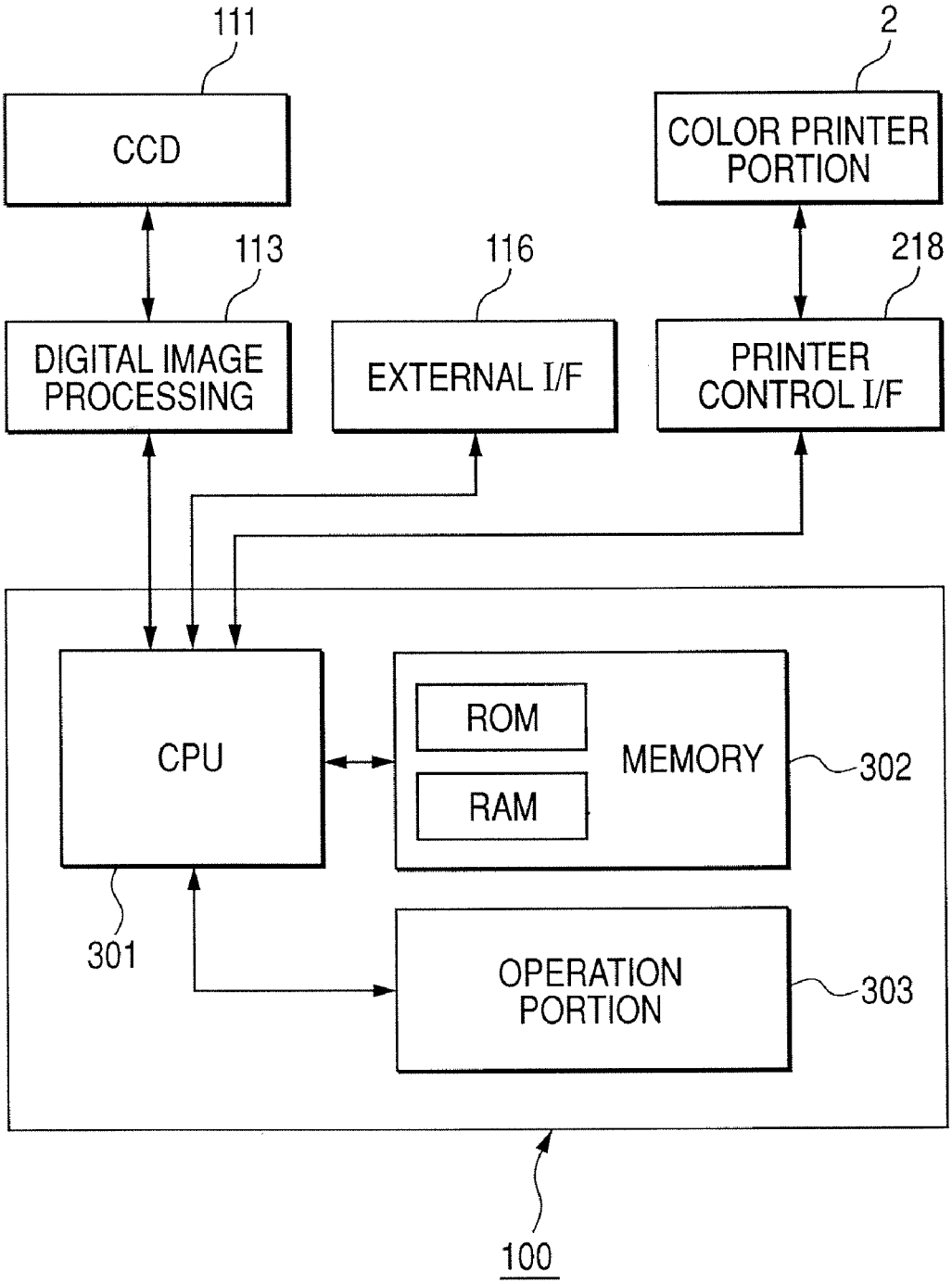
FIG. 2 is a block diagram schematically showing a control processing portion of FIG. 1.
Figure 3:
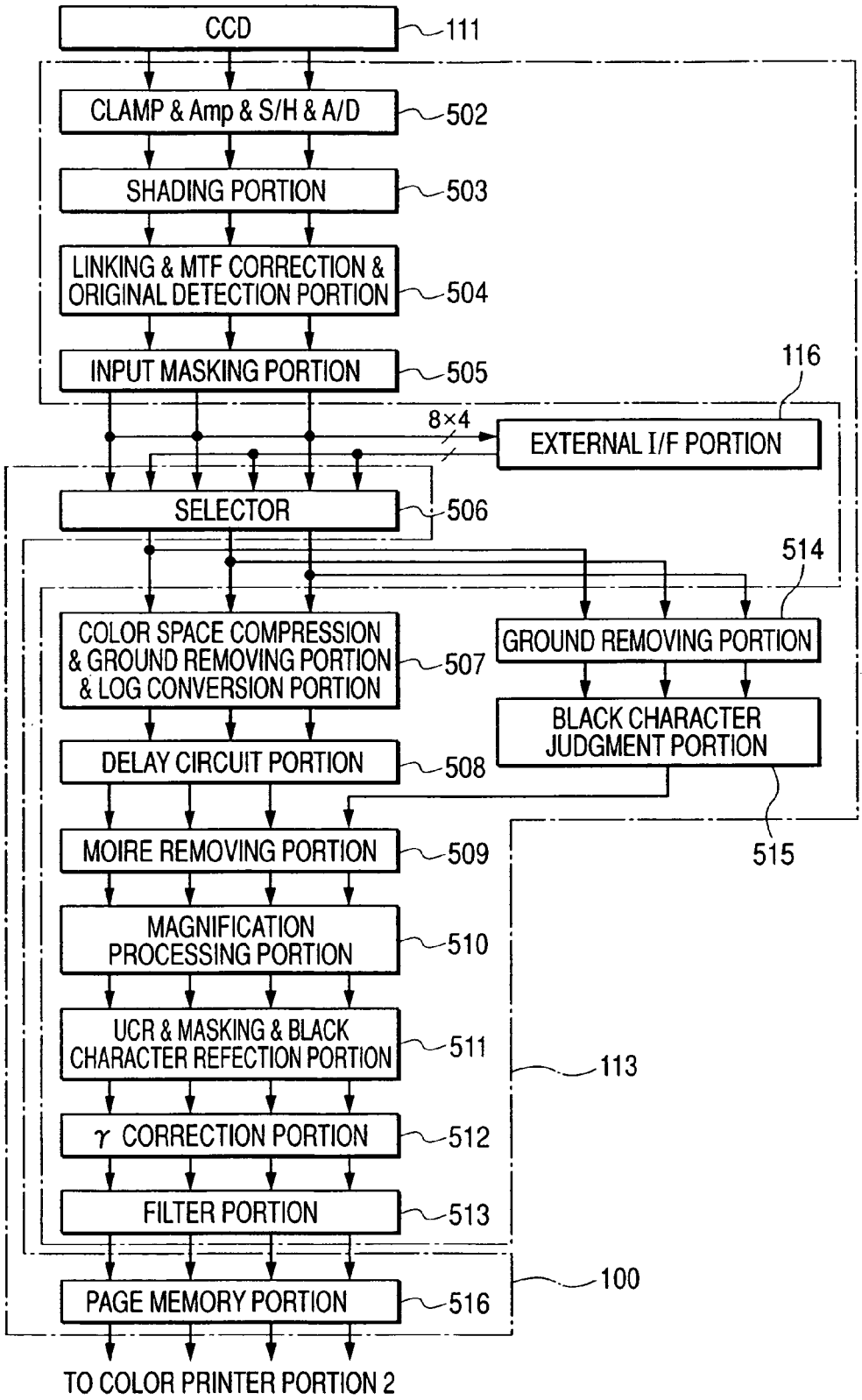
FIG. 3 is a detailed block diagram showing a digital image processing portion of FIG. 2.

FIG. 3 is a detailed block diagram showing the digital image processing portion 113 of FIG. 2.

Referring to FIG. 3, the digital image processing portion 113 includes a clamp & AMP & S/H & A/D portion 502, a shading portion 503, a linking & MTF correction & original detection portion 504, and an input masking portion 505.

The clamp & AMP & S/H & A/D portion 502 performs sample hold (S/H) of an analog image signal inputted from the CCD 111 to clamp a dark level of the analog image signal at a reference potential. After the analog image signal is amplified to a predetermined amount, the clamp & AMP & S/H & A/D portion 502 performs analog-to-digital conversion to the analog image signal into a digital signal having eight bits in each of RGB (hereinafter referred to as RGB digital signal). The above process sequence is not limited to the order shown in FIG. 3. The shading portion 503 performs shading correction and black correction to the RGB digital signal.

The linking & MTF correction & original detection portion 504 performs a linking processing and MTF correction to the RGB digital signal to which the shading correction has been performed, and the linking & MTF correction & original detection portion 504 recognizes a size of the original by scanning the original on the original plate 101. When the three-line CCD is used as the CCD 111, in the linking processing performed by the linking & MTF correction & original detection portion 504, reading positions differ from one another among the lines. Therefore, in this case, the linking processing means the process in which a delay amount is adjusted in each line according to reading speed and signal timing is corrected so that the reading positions of three lines are equalized. The MTF correction means the process of correcting the MTF change, because reading MTF is changed by the reading speed and magnification.

The input masking portion 505 corrects the digital signal whose reading position timing is corrected by the linking & MTF correction & original detection portion 504 base on spectral characteristics of the CCD 111 and spectral characteristics of the light sources 103 and 104 and the light reflector 105 and 106.

The control portion 100 includes a selector 506.

The signal from the input masking portion 505 and the signal from the external I/F 116 are inputted to the selector 506. The selector 506 outputs one of the signals to a color space compression & background removing & LOG conversion portion 507 and a background removing portion 514 in the digital image processing portion 113.

The digital image processing portion 113 also includes the background removing portion 514, a black character judgment portion 515, and the color space compression & background removing & LOG conversion portion 507. The digital image processing portion 113 further includes a delay circuit portion 508, a moire removing portion 509, a magnification processing portion 510, a UCR & masking & black character reflection portion 511, a gamma correction portion 512, and a filter portion 513.

The background removing portion 514 performs background removal to the signal outputted from the selector 506. The black character judgment portion 515 generates a black character signal, when the signal to which the background removal has been performed by the background removing portion 514 is the black character in the original. When the signal from the selector 506 falls within the range where the signal can directly be reproduced by the printer, the color space compression & background removing & LOG conversion portion 507 does not perform the correction. When the signal from the selector 506 falls within the range where the signal cannot be reproduced by the printer, the color space compression & background removing & LOG conversion portion 507 performs the correction to the image signal such that the signal can be reproduced by the printer. Then, the color space compression & background removing & LOG conversion portion 507 converts the RGB signal into a YMC signal after performing the background removing process.

The delay circuit portion 508 adjusts timing between the output signal of the color space compression & background removing & LOG conversion portion 507 and the signal generated by the black character judgment portion 515. The moire removing portion 509 removes the moires of the signal generated by the black character judgment portion 515 and the signal to which the timing is adjusted by the delay circuit portion 508. The magnification processing portion 510 performs magnification process in the main scanning direction to the two kinds of the signals to which the moire is removed by the moire removing portion 509.

The UCR & masking & black character reflection portion 511 generates a YMCK signal by a URC process from the YMC signal in the two kinds of the signals processed by the magnification processing portion 510. Then, while the UCR & masking & black character reflection portion 511 corrects the generated YMCK signal into the signal matching the print output, the UCR & masking & black character reflection portion 511 performs feedback of the other signal (judgment signal generated by the black character judgment portion 515) in the two kinds of the signals to the corrected YMCK signal. The gamma correction portion 512 performs density adjustment to the signal processed by the UCR & masking & black character reflection portion 511. The filter portion 513 performs smoothing or edge processing to the signal to which the density adjustment has been performed by the gamma correction portion 512.

The control portion 100 further includes a page memory portion 516. The page memory portion 516 receives image data, to which the edge processing and the like are performed by the filter portion 516, from the digital image processing portion 113, and the page memory portion 516 temporarily stores the image data. Then, according to image writing reference timing from the printer control portion 250, the page memory portion 516 sequentially transmits the image data to the printer control portion 250 in synchronization with a video clock.

Returning to FIG. 1, the configuration of the color printer portion 2 will be described.

The printer control portion 250 performs the printing control of the color printer portion 2 according to the control signal such as a printing start signal outputted from the CPU 301 on the control portion 100 which controls the whole of the full-color image forming apparatus 1000. The reference numeral 201 denotes a laser scanner. The laser scanner 201 irradiates a photosensitive drum (photosensitive member) 202 with a laser beam corresponding to the image data signal by scanning the laser beam with a polygon mirror in the main scanning direction, which forms an electrostatic latent image on the photosensitive drum 202.

The electrostatic latent image formed by the photosensitive drum 202 reaches a sleeve position of one color in a four-color developing rotary by the clockwise rotation of the photosensitive drum 202. An amount of toner flies from a color developing device 203 to the photosensitive drum 202 surface according to an amount of potential formed between the photosensitive drum 202 surface on which the electrostatic latent image is formed and the developing sleeve surface to which a developing bias is applied. The electrostatic latent image (toner image) on the photosensitive drum 202 surface is developed to form the toner image on the photosensitive drum 202.

The toner image formed on the photosensitive drum 202 is transferred to an intermediate transfer member 205, rotated in a counterclockwise direction, by the clockwise direction of the photosensitive drum 202. In the case of the black monochrome development, the image is sequentially formed on the intermediate transfer member 205 at predetermined time intervals, and the primary transfer is performed. In the case of the full color image, in the electrostatic latent image corresponding to each of the colors on the photosensitive drum 202, the sleeve position of the developing rotary is sequentially determined in each color, and the development and the primary transfer are performed. After four rotations of the intermediate transfer member 205, i.e. at the time when the primary transfer of the four colors is performed, the primary transfer of the full color image is completed.

The reference numeral 221 denotes a registration roller. The registration roller 221 conveys the recording sheet between the intermediate transfer member 205 and a secondary transfer roller 206 when the full color image is fully transferred to the intermediate transfer member 205. In the case of the automatic sheet feed, the recording sheet conveyed by the registration roller 221 is picked up from each cassette (upper-stage cassette 208, lower-stage cassette 209, third stage cassette 210, and fourth stage cassette 211) by each of pickup rollers 212, 213, 214, and 215 in each cassette stage. The recording sheet is conveyed by each of sheet feed rollers 216, 217, 218, and 219 in each cassette stage, and the recording sheet is conveyed to the registration roller 221 by longitudinal path conveying rollers 222, 223, 224, and 225.

On the other hand, in the case of the manual sheet feed, the recording sheet is conveyed from a manual sheet feed tray 240 to the registration roller 221 by a sheet feed roller 220. The recording sheet conveyed between the secondary transfer roller 206 and the intermediate transfer member 205 by the registration roller 221 is conveyed toward the direction of a fixing unit 242 while nipped between the secondary transfer roller 206 and the intermediate transfer member 205. The recording sheet is pressed against the intermediate transfer member 205, and secondary transfer is performed to the toner image on the intermediate transfer member 205. The fixing unit 242 heats and presses the recording sheet, to which the secondary transfer has been performed, to fix the toner image to the recording sheet with a fixing roller and a pressing roller 207 inside the fixing roller 242.

The reference numerals 233 and 234 denote a sheet discharging roller. In the case of first sheet discharging in which the recording sheet to which the image is fixed is discharged to a sheet discharging tray (not shown) connected to the sheet discharging roller 233, a first sheet discharging flapper 237 is switched to the direction of the sheet discharging roller 233 to discharge the recording sheet to the sheet discharging roller 233. In the case of second sheet discharging in which the recording sheet is discharged to a sheet discharging tray (not-shown) connected to the sheet discharging roller 234, the first sheet discharging flapper 237 and a second sheet discharging flapper 238 are switched to the direction of the sheet discharging roller 234 to discharge the recording sheet to the sheet discharging roller 234.

The reference numeral 235 denotes a reversal roller. In the case of third sheet discharging in which the recording sheet to which the image is fixed is discharged to a sheet discharging tray (not shown) connected to a sheet discharging roller 239, the first sheet discharging flapper 237 and the second sheet discharging flapper 238 are switched to the direction of the sheet discharging roller 235 to discharge the recording sheet to the sheet discharging roller 235. The reference numeral 236 denotes a third sheet discharging roller. The recording sheet reversed by the reversal roller 235 is discharged to the third sheet discharging roller 236 by switching a third sheet discharging flapper 251 to the direction of the third sheet discharging roller 236 to discharge the recording sheet to the third sheet discharging roller 236.

Figure 7:
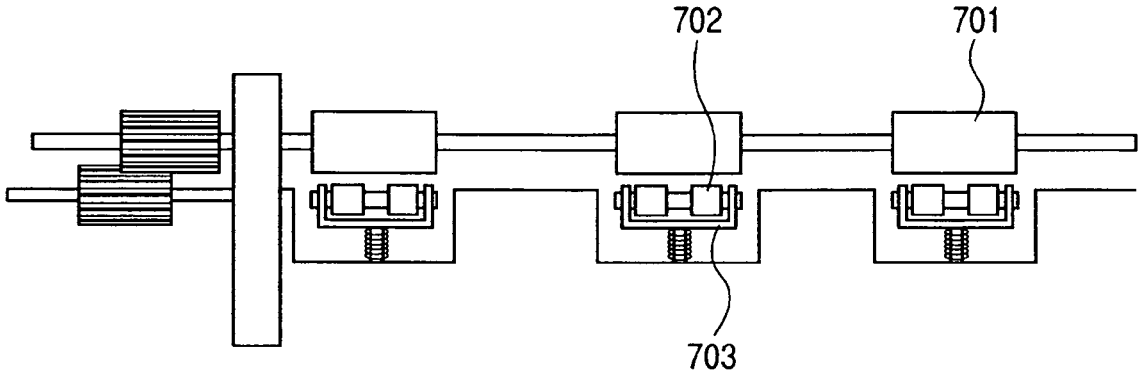
FIG. 7 is a sectional view schematically showing a sheet discharging portion of the conventional image forming apparatus.
Figure 8:
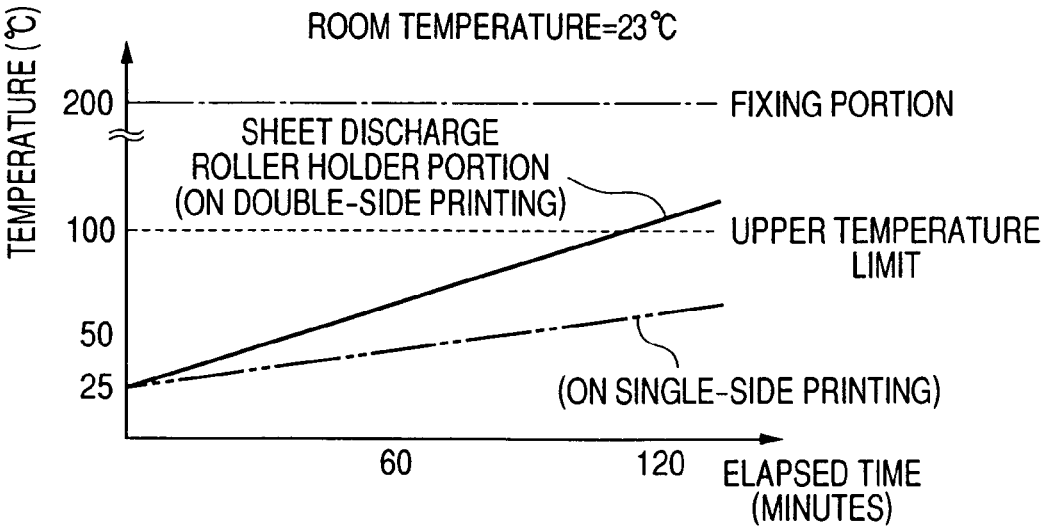
FIG. 8 is a graph showing the time change in temperature of the sheet-discharging roller holder when printing is performed at the room temperature of 23° C.

The reference numerals 233*a*, 234*a*, and 239 denote a sheet discharging roller. The sheet discharging rollers 233*a*, 234*a*, and 239 nip the recording sheet in conjunction with the motor-driven sheet discharging rollers 233, 234, and 236, and the sheet discharging rollers 233*a*, 234*a*, and 239 discharge the recording sheet by the rotation along with the recording sheet during the passage of the recording sheet. As with the conventional image forming apparatus (see FIG. 7), the sheet discharging rollers 233*a*, 234*a*, and 239 are supported by the sheet discharging roller holder 703 having the structure in which the sheet discharging roller holder 703 is vertically movable by the spring in order to smoothly performing the sheet discharging. For the purpose of the cost reduction, the sheet discharging roller holder 703 is made of the material such as polycarbonate having relatively low heat-resistant temperatures ranging from 90° C. to 115° C.

When the recording sheet to which the double-side printing is performed is discharge, as with the third sheet discharging, the reversal action is temporarily performed by the reversal roller 235 to the recording sheet to which the image is fixed. Then, the third sheet discharging flapper 251 is switched to the direction of a double-side unit (not shown) to convey the recording sheet to the double-side unit. Until a predetermined time elapses since the recording sheet is detected by a double-side sensor (not shown), the conveyance of the recording sheet is temporarily stopped in the double-side unit. Once the image formation is prepared for a second surface, the recording sheet in the double-side unit is conveyed to the registration roller 221, and the image is formed in the second surface.

The reference numeral 241 denotes a cooling fan which is installed near the fixing unit 242 so as to exhaust the heat in the fixing unit 242 to the outside of the apparatus. The cooling fan 241 can be switched to plural rotating speeds and the cooling fan 241 is controlled by the printer control portion 250. The cooling fan 241 can be rotated at the two different numbers of rotations by switching drive voltages. Hereinafter, in the first embodiment, the larger number of rotations in the two different numbers of rotations is referred to as full speed, and the other number of rotations which is about a half number of rotations of the full speed is referred to as half speed. The reference numeral 243 denotes a transfer portion thermistor which detects the temperature near the photosensitive drum 202 and the intermediate transfer member 205. The transfer portion thermistor 243 is installed near the photosensitive drum 202 and the intermediate transfer member 205. The printer control portion 250 performs the rotating-speed switching of the cooling fan 241 by the following process of FIG. 4 based on the temperature detected by the transfer portion thermistor 243.

Figure 4:
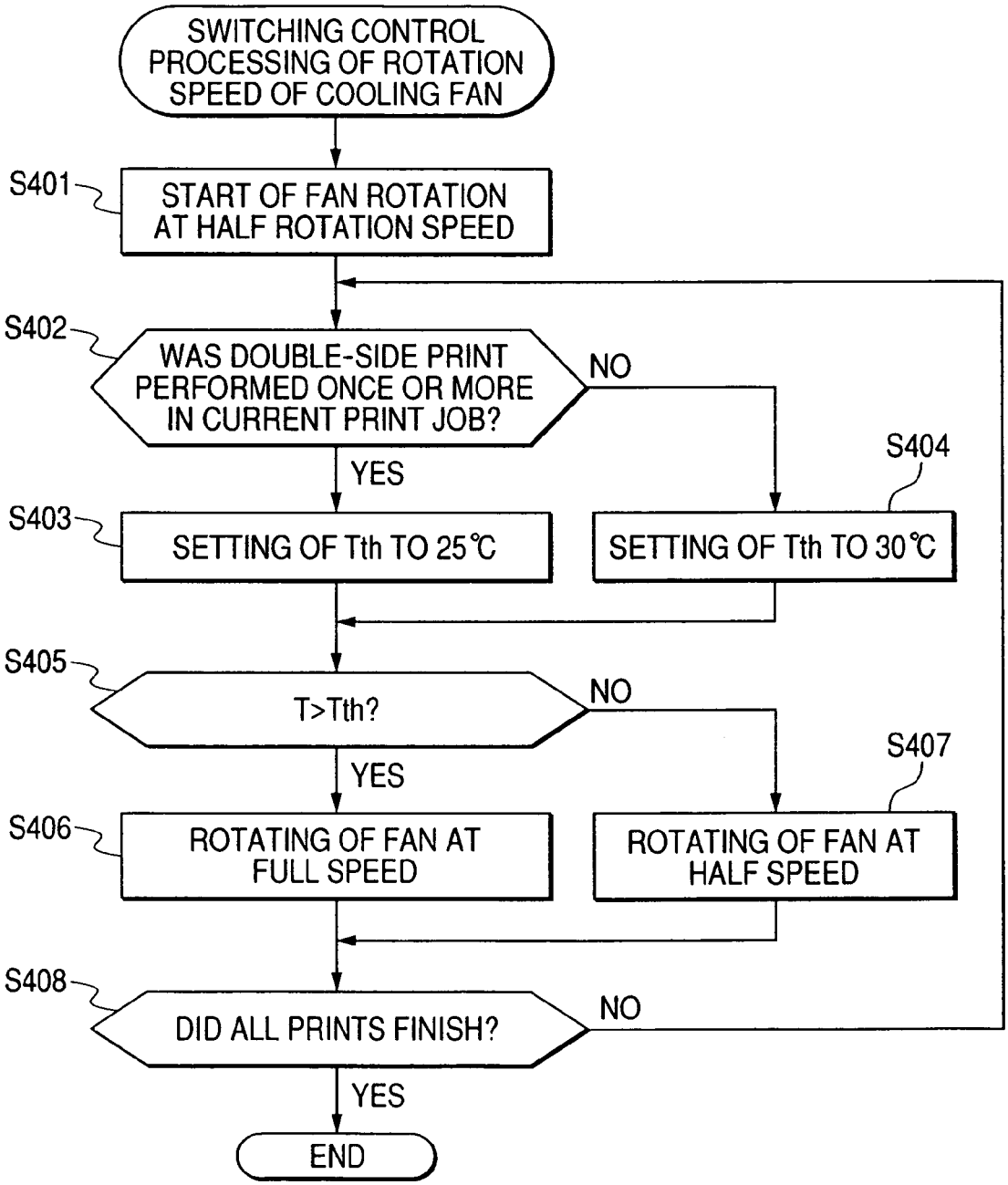
FIG. 4 is a flowchart showing a process of controlling rotating-speed switching of a cooling fan during printing operation, which is performed by a printer control portion of FIG. 1.

FIG. 4 is a flowchart showing a process of controlling rotating-speed switching of the cooling fan 241 during the printing operation, which is performed by the printer control portion 250 of FIG. 1.

Referring to FIG. 4, when the printing action is started, the cooling fan 241 is rotated at "half speed" (Step S401).

Then, it is determined whether at least one-time double-side printing is performed or not in the current print job (Step S402). Specifically, when a value of a double-side counter is larger than one, it is determined that at least one-time double-side printing is performed in the current print job. The counting of the double-side counter is controlled by a double-side printing counting process shown in FIG. 5 which is performed in parallel with the process of controlling rotating-speed switching of the cooling fan 241.

As a result of the determination in Step S402, when the at least one-time double-side printing is performed (the value of double-side counter is larger than one), a switching temperature (threshold value Tth) of the fan rotating speed is set at a first temperature (25° C.) (Step S403). When the double-side printing is never performed, i.e. when only the single-side printing is performed (the value of double-side counter is zero), the switching temperature (threshold value Tth) of the fan rotating speed is set at a second temperature (30° C.) (Step S404). Then, the flow goes to Step S405.

The first switching temperature and the second switching temperature are previously stored in the memory 302 of the control portion 100 in the color reader portion 1. The second switching temperature is set at the temperature higher than the first switching temperature. Generally, when compared with the double-side printing, the temperature raise inside the full-color image forming apparatus 1000 is moderate during the single-side printing. Therefore, when the switching temperatures of the fan rotating speed are set in the above manner, while the component deformation caused by the increased temperature can be prevented in the full-color image forming apparatus 1000, the number of rotations of the cooling fan 241 can securely be suppressed at the minimum.

Then, in Step S405, it is determined whether a detection temperature T detected by the transfer portion thermistor 243 is higher than the switching temperature (threshold value Tth) of the fan rotating speed. As a result of the determination in Step S405, when the detection temperature T is higher than the threshold value Tth, the rotating speed of the cooling fan 241 is switched to "full speed" (Step S406). On the other hand, when the detection temperature T is equal to or less than the threshold value Tth, the rotating speed of the cooling fan 241 is switched to "half speed" (Step S407). Then, it is determined whether all the prints are finished or not (Step S408).

As a result of the determination in Step S408, when the printing is not finished, the processes from Step S402 are performed. On the other hand, when all the prints are finished, the process of controlling rotating-speed switching of the cooling fan 241 is ended.

According to the process shown in FIG. 4, the printer control portion 250 rotates the cooling fan 241 is rotated at "half speed" when the printing action is started (Step S401). Then, when the at least one-time double-side printing is performed (YES in Step S402), the switching temperature (threshold value Tth) of the fan rotating speed is set at 25° C. (Step S403). When only the single-side-printing is performed (NO in Step S402), the switching temperature (threshold value Tth) of the fan rotating speed is set at 30° C. (Step S404). When the detection temperature T detected by the transfer portion thermistor 243 is higher than the set switching temperature of the fan rotating speed (threshold value Tth), the rotating speed of the cooling fan 241 is switched to "full speed" (Step S406). Accordingly, while the component deformation caused by the increased temperature can be prevented in the full-color image forming apparatus 1000, the silence and the electric power saving can be realized by suppressing the number of rotations of the cooling fan 241 at the minimum.

Figure 5:
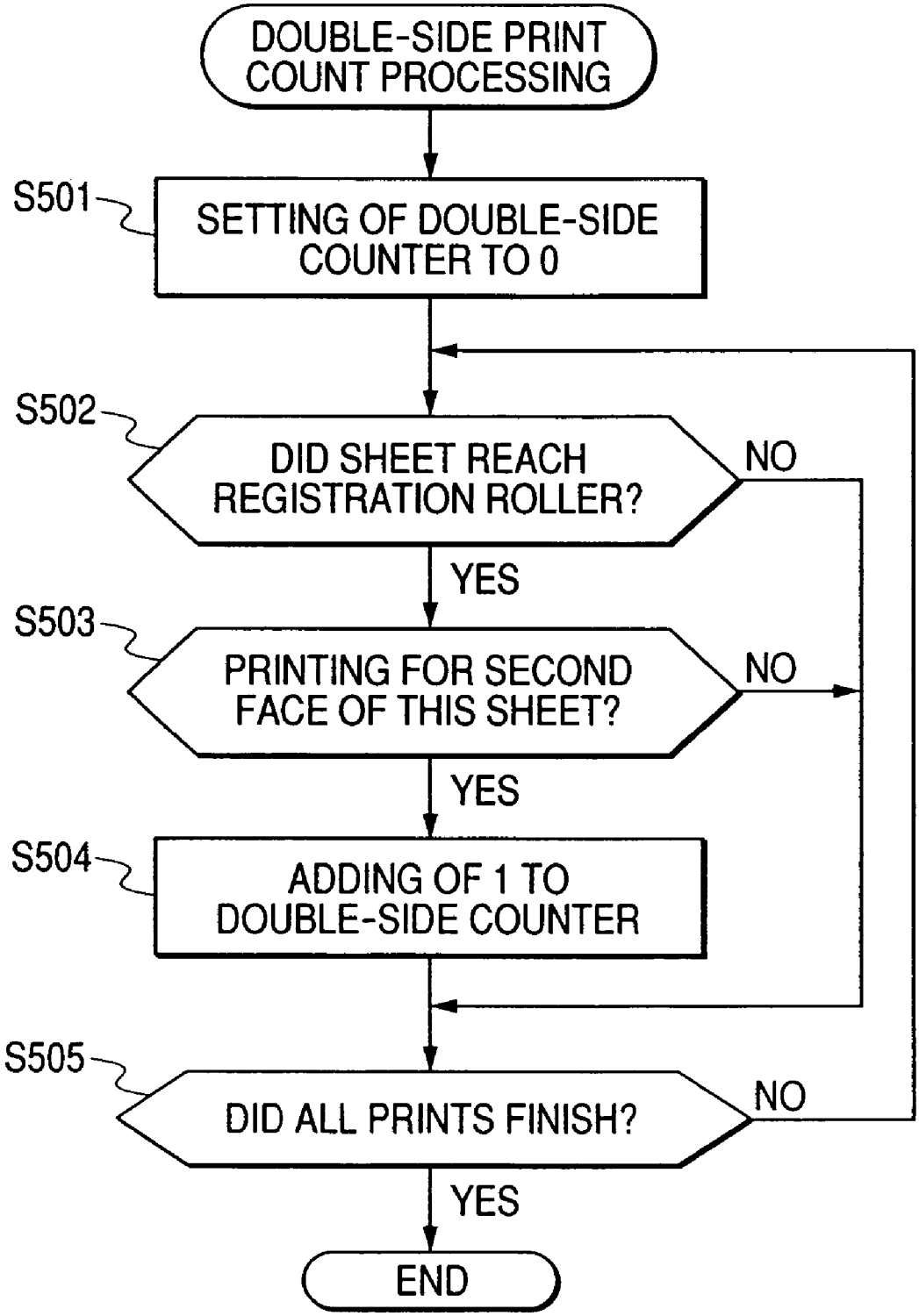
FIG. 5 is a flowchart showing a double-side print counting process which is performed by the printer control portion of FIG. 1.

FIG. 5 is a flowchart showing a double-side print counting process which is performed by the printer control portion 250 of FIG. 1.

Referring to FIG. 5, when the print job is started, a value of the double-side counter which counts the number of times of the double-side printing is set at zero (Step S501).

Then, it is determined whether the recording sheet reaches the registration roller 221 or not (Step S502). As a result of the determination, when the recording sheet reaches the registration roller 221, it is determined whether the printing is the second surface (backside) printing of the recording sheet or not (Step S503). When the printing is not the backside printing, the flow goes directly to Step S505. When the printing is the backside printing, the double-side counter is incremented by one (Step S504), and the flow goes to Step S505. As a result of the determination in Step S502, when the recording sheet does not reach the registration roller 221, the flow also goes to Step S505.

In Step S505, it is determined whether all the prints are finished or not. As a result of the determination in Step S505, when the printing is not finished, the processes from Step S502 are performed. On the other hand, when all the prints are finished, the process is ended.

Figure 6A:
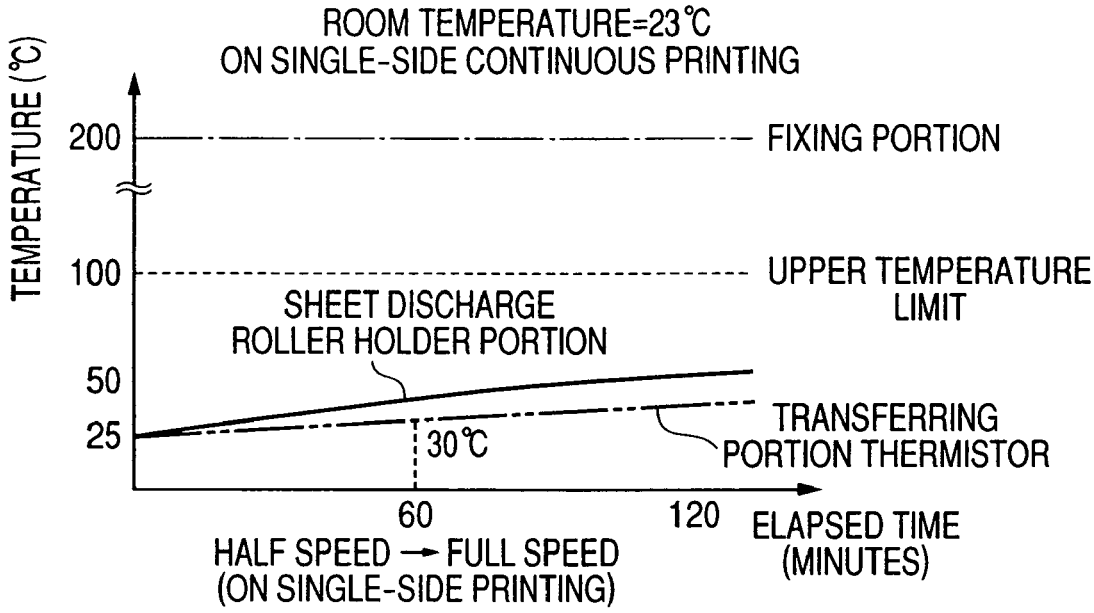
FIG. 6A is a graph showing time changes in temperature of a sheet-discharging roller holder and in detection temperature by a transfer portion thermistor when single-side continuous printing is performed at a room temperature of 23° C.
Figure 6B:
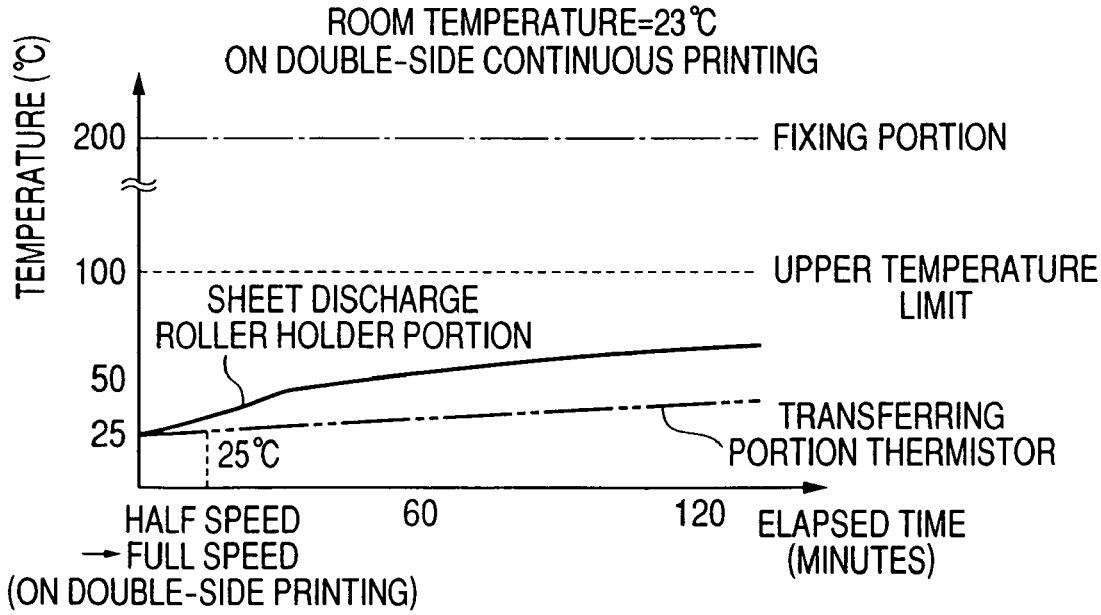
FIG. 6B is a graph showing the time changes in temperature of the sheet-discharging roller holder and in detection temperature by the transfer portion thermistor when double-side continuous printing is performed at the room temperature of 23° C.

FIGS. 6A and 6B are a graph showing time changes in temperature of the sheet-discharging roller holder and in detection temperature by the transfer portion thermistor 243 when the printing is performed at a room temperature of 23° C. FIG. 6A shows the single-side continuous printing, and FIG. 6B shows the double-side continuous printing.

In both the cases, the temperature of the sheet discharging roller holder is suppressed so as not to reach the heat-resistant temperature (100° C.). When the elapsed time is equal to or less than 60 minutes during the single-side continuous printing, the temperature of the transfer portion thermistor 243 does not reach 30° C. which is of the switching temperature (threshold value Tth) of the fan rotating speed (Step 404 in FIG. 4). Therefore, in almost all the cases of the normal use, the rotating speed of the cooling fan 241 can be suppressed to "half speed." Accordingly, while the component deformation caused by the increased temperature can be prevented in the full-color image forming apparatus 1000, the silence and the electric power saving can be realized by suppressing the number of rotations of the cooling fan 241 at the minimum.

In the first embodiment, the temperature is detected by the transfer portion thermistor 243. However, the invention is not limited to the temperature detection method of the first embodiment as long as the temperature in the full-color image forming apparatus 1000 can be detected. For example, it is also possible that the thermistor is installed in another portion. In the first embodiment, for the purpose of safety, that at least one-time double-side printing is included in the print job is set to the determination condition that the rotational control of the cooling fan 241 is started (Step S402). However, the invention is not limited to the above determination condition. For example, it is possible that the performance of the predetermined plural-time double-side printing during the print job is set to the determination condition. With reference to the cooling unit which cools the inside-of the apparatus, the invention is not limited to the cooling fan of the first embodiment, which exhausts the heat in the apparatus to the outside of the apparatus, but the cooling unit having another configuration is also used.

In the object of the invention, it is possible that a storage medium (recording medium) in which a program code of software for realizing the function of the first embodiment is recorded is supplied to a system or the apparatus. Needless to say, the object of the invention can be achieved such that a computer (or a CPU or an MPU) incorporated in the system or the apparatus reads and executes the program code stored in the storage medium.

In this case, the program code itself read from the storage medium realizes the function of the first embodiment, and the storage medium in which the program code is stored constitutes the invention.

The invention includes the case in which execution of the program code read by the computer realizes the function of the first embodiment, and the invention also includes the case in which an operating system (OS) running on the computer and the like execute a part of or all the actual process based on a direction of the program code and thereby the function of the first embodiment is realized.

The invention also includes the case, in which the program code read from the storage medium is written in a function enhancement card inserted into the computer or a function enhancement unit connected into the computer, the CPU and the like incorporated in the function enhancement card or the function enhancement unit execute a part of or all the actual process based on a direction of the program code, and thereby the function of the first embodiment is realized.

Any program in which the function of the first embodiment can be realized by the computer is used as the above program. With reference to a mode of the program, it is possible to use the program which is executed by an object code or an interpreter, and the program having script data supplied to the operating system.

Examples of the recording medium which supplies the program include a RAM, an NV-RAM, a floppy (trade mark) disk, an optical disk, a magneto-optical disk, a CD-ROM, an MO, a CD-R, a CD-RW, a DVDs (a DVD-ROM, a DVD-RAM, a DVD-RW, a DVD+RW), magnetic tape, non-volatile memory card, and other ROMs. Namely, it is possible to use any recording medium in which the program can be stored. Alternatively, the program may be supplied by download from Internet, a commercial network, a local area network, and a data base with another computer (not shown).

This application claims priority from Japanese Patent Application No. 2004-261455 filed on Sep. 8, 2004, which is hereby incorporated by reference herein.

What is claimed is:

1. An image forming apparatus comprising:

a printing unit which performs printing in a recording sheet by double-side printing or single-side printing;

a temperature detection unit which detects a temperature of the inside of the image forming apparatus;

a cooling unit which cools the inside of said image forming apparatus; and a controller which compares the temperature detected by said temperature detection unit to a threshold value to control action of said cooling unit according to the comparison result, said controller setting a first temperature as the threshold value when only the single-side printing is performed by said printing unit, said controller setting a second temperature as the threshold value when at least one-time double-side printing is performed by said printing unit, the second temperature being lower than the first temperature.

2. An image forming apparatus according to claim 1, wherein said controller performs control such that said cooling unit becomes a first state when the temperature detected by said temperature detection unit is equal to or less than the threshold value, and said controller performs control such that said cooling unit becomes a second state when the temperature detected by said temperature detection unit is more than the threshold value, said cooling unit strongly cooling the inside of said image forming apparatus in the second state when compared with the first state.

3. An image forming apparatus according to claim 1, wherein said cooling unit includes a cooling fan, said controller performs control so as to rotate said cooling fan at a first rotating speed when the temperature detected by said temperature detection unit is equal to or less than the threshold value, and said controller performs control so as to rotate said cooling fan at a second rotating speed when the temperature detected by said temperature detection unit is higher than the threshold value, the second rotating speed being faster than the first rotating speed.

4. An image forming apparatus according to claim 1, wherein said printing unit has a photosensitive member and said temperature detection unit is installed near the photosensitive member.

5. An image forming apparatus according to claim 1, wherein said printing unit has an intermediate transfer member and said temperature detection unit is installed near the intermediate transfer member.

6. A method of controlling an image forming apparatus which includes a printing unit for performing printing in a recording sheet by double-side printing or single-side printing, a temperature detection unit for detecting a temperature of the inside of said image forming apparatus, and a cooling unit for cooling the inside of said image forming apparatus, the method comprising:

a control step of comparing the temperature detected by said temperature detection unit to a threshold value to control action of said cooling unit according to the comparison result; and a threshold value setting step of setting a first temperature as the threshold value when only the single-side printing is performed by said printing unit, the threshold value setting step of setting a second temperature as the threshold value when at least one-time double-side printing is performed by said printing unit, the second temperature being lower than the first temperature.

7. A program stored in a computer readable medium for executing a method of controlling an image forming apparatus which includes a printing unit for performing printing in a recording sheet by double-side printing or single-side printing, a temperature detection unit for detecting a temperature of the inside of said image forming apparatus, and a cooling unit for cooling the inside of said image forming apparatus, the program comprising:

a control module which compares the temperature detected by said temperature detection unit to a threshold value to control action of said cooling unit according to the comparison result; and a threshold value setting module which sets a first temperature as the threshold value when only the single-side printing is performed by said printing unit, the threshold value setting module setting a second temperature as the threshold value when at least one-time double-side printing is performed by said printing unit, the second temperature being lower than the first temperature.

* * * * *

UNITED STATES PATENT AND TRADEMARK OFFICE

CERTIFICATE OF CORRECTION

PATENT NO. : 7,269,374 B2
APPLICATION NO. : 11/218540
DATED : September 11, 2007
INVENTOR(S) : Yushi Oka It is certified that error appears in the above-identified patent and that said Letters Patent is hereby corrected as shown below:

ON THE TITLE PAGE:
At Item (56), References Cited, Foreign Patent Documents, insert --JP 2003-270890 9/2003--, and --JP 2004-117732 4/2004--.

IN THE DRAWINGS:
Sheet No. 3, Figure 3, "REFECTION" should read --REFLECTION--.

COLUMN 1:
Line 61, "tend" should read --tends--.

COLUMN 2:
Line 9, "performing" should read --perform--.
Line 45, "in" should read --on--.

COLUMN 4:
Line 7, "direction-X)" should read --direction X--.
Line 15, "the" should be deleted.
Line 17, "to" should read --to use--.

COLUMN 5:
Line 10, "base" should read --based--.
Line 13, "reflector" should read --reflectors--.

COLUMN 7:
Line 51, "a" should be deleted.
Line 52, "roller." should read --rollers.--.
Line 64, "performing" should read --perform--.

COLUMN 8:
Line 2, "discharge," should read --discharged--.
Line 14, "in" should read --on--.
Line 65, "raise" should read --rise--.

COLUMN 9:
Line 25, "is rotated" should be deleted.
Line 66, "a graph" should read --graphs--.

UNITED STATES PATENT AND TRADEMARK OFFICE

CERTIFICATE OF CORRECTION

PATENT NO. : 7,269,374 B2
APPLICATION NO. : 11/218540
DATED : September 11, 2007
INVENTOR(S) : Yushi Oka It is certified that error appears in the above-identified patent and that said Letters Patent is hereby corrected as shown below:

COLUMN 11:
Line 8, "a" (third occurrence) should be deleted.
Line 21, "in" should read --on--.
Line 39, "becomes" should read --enters--.
Line 42, "becomes" should read --enters--.

COLUMN 12:
Line 14, "in" should read --on--.
Line 34, "in" should read --on--.

Signed and Sealed this

Sixth Day of May, 2008

JON W. DUDAS
*Director of the United States Patent and Trademark Office*